United States Patent [19]

Hartman

[11] Patent Number: 4,615,085

[45] Date of Patent: Oct. 7, 1986

[54] BURIAL CASKET HARDWARE ALIGNMENT DEVICE

[75] Inventor: Robert J. Hartman, Batesville, Ind.

[73] Assignee: Batesville Casket Company, Inc., Batesville, Ind.

[21] Appl. No.: 660,583

[22] Filed: Oct. 15, 1984

[51] Int. Cl.[4] ..... A61G 17/00

[52] U.S. Cl. ..... 27/1; 16/112

[58] Field of Search ..... 27/27, 10, 2, 1, 3–6; 16/112, 114

[56] References Cited

U.S. PATENT DOCUMENTS

| | | | |
|---|---|---|---|
| 804,875 | 11/1905 | Nierstheimer | 16/112 |
| 1,620,770 | 3/1927 | Ledwidge | 16/112 |
| 1,660,703 | 2/1928 | Beck | 16/112 |
| 2,121,885 | 6/1938 | Rogers | 16/112 |
| 2,330,141 | 9/1943 | Olson | 16/112 |
| 2,485,833 | 10/1949 | Kendall | 16/112 |
| 3,204,286 | 9/1965 | Hillenbrand | 16/112 |
| 3,657,764 | 4/1972 | Relly et al. | 16/112 |

*Primary Examiner*—James R. Feyrer

*Attorney, Agent, or Firm*—F. Kristen Koepcke; Brian J. Leitten

[57] ABSTRACT

The present invention is directed to a dual-functioning alignment and trim device for a burial casket. An alignment and trim strip is attached to the back side of a series of decorative plates which are in turn attached to handle arms and casket handles. The trim strips are fastened in a suitable fashion, preferably by a cooperating boss and aperture arrangement. The trim strip passes through notches formed in the sides of the decorative plates and serves to align a series of decorative plates affixed to one side of a burial casket. The trim strip may conveniently be attached to the casket hardware, i.e., to the decorative plates, prior to assembly of the handle and associated hardware to the burial casket wall. In this fashion, each of the decorative plates employed is aligned in the proper position on the face of the casket wall and with respect to the other decorative plates.

4 Claims, 4 Drawing Figures

BURIAL CASKET HARDWARE ALIGNMENT DEVICE

BACKGROUND AND OBJECTS OF THE INVENTION

The present invention relates to burial caskets and, in particular, to devices which function to align and trim burial casket hardware.

The handles on a burial casket are used during that portion of a burial service when the pallbearers lift the casket during the carrying of the casket to the burial place or in a pre-burial service. The casket, with the body in it, may weigh several hundred pounds, and handles are therefore necessary to assist the pallbearers in moving the casket. Typically, a series of arms are connected to the side walls of a casket, with one end of each arm being affixed to the casket and the other end of each arm being configured to hold a handle. Typically, a burial casket handle is a generally straight tubular member which extends from near one end to near the other end of each side of the burial casket.

A variety of configurations of burial casket handles have been designed in the past. One such design is that disclosed in U.S. Pat. No. 3,204,286. That patent describes a swingable burial casket handle assembly which is movable from a position directly adjacent the casket wall to a position up away from said wall, and which incorporates decorative plates designed to cover the attaching means for the handle assemblies. The disclosure of U.S. Pat. No. 3,204,286 is incorporated herein by reference as if it were a part of this application.

While the burial casket handle assembly described in U.S. Pat. No. 3,204,286 was well received by the funeral industry, since it substantially reduced the cost of manufacturing a casket contributed by the handles and their installation, this handle assembly continues to suffer from one drawback. In particular, difficulties have arisen in assembly of the casket hardware, namely, the decorative plates, arms and casket handles. During assembly, the decorative plate which hides the area of attachment of the handle arm is affixed to the wall of the casket by the use of a single bolt. Since substantial play may exist between the bolt and the aperture in the decorative plate through which the bolt is inserted, decorative plates are often misaligned on the casket wall during assembly. This problem exists where there is excessive play in a decorative plate which is held on by two handle arms, and is particularly troublesome in those caskets where a single handle arm is used to secure each decorative plate. In this instance, significant rotation about the pivot point by which the decorative plate is joined to the casket wall can occur, causing unacceptable misalignment. This in turn requires costly additional steps, e.g., that a specific, misaligned casket be removed from the assembly procedure and adjusted, or in the alternative requires that additional time and care be spent during the assembly process to insure that proper alignment is achieved.

It is, therefore, an object of the present invention to eliminate the problem of misalignment in the decorative plates affixed to burial caskets.

Another object of the present invention is to further minimize the expense associated with manufacturing burial caskets and, in particular, with assembling the handle and decorative plate portions thereof.

Yet another object of the present invention is to provide a burial casket with an alignment strip which properly orients the casket hardware affixed to the outer casket walls.

A further object of the present invention is to provide a decorative trim strip which may be easily assembled onto a burial casket in conjunction with the assembly of the burial casket handles and decorative plates.

SUMMARY OF THE INVENTION

These and other objects are achieved by the present invention, which is directed to a dual-functioning alignment and trim device for a burial casket. In particular, an alignment and trim strip is attached to the back side of a series of decorative plates which are in turn attached to handle arms and casket handles. The trim strips are fastened in a suitable fashion, preferably by a cooperating boss and aperture arrangement, and the trim strip passes through notches formed in the sides of the decorative plates. In this fashion, the trim strip serves to align a series of decorative plates affixed to one side of a burial casket. The trim strip may conveniently be attached to the casket hardware, i.e., to the decorative plates, prior to assembly of the handle and associated hardware to the burial casket wall. In this fashion, each of the decorative plates employed is aligned in the proper position on the face of the casket wall and with respect to the other decorative plates.

THE DRAWINGS

The objects and advantages of the present invention will become apparent from the following detailed description of the preferred embodiments thereof, in connection with the accompanying drawings in which like numerals designate like elements, and in which.

DETAILED DESCRIPTION OF PREFERRED EMBODIMENTS OF THE INVENTION

In accordance with the present invention, there is provided a burial casket having a novel hardware assembly.

Figure 1:
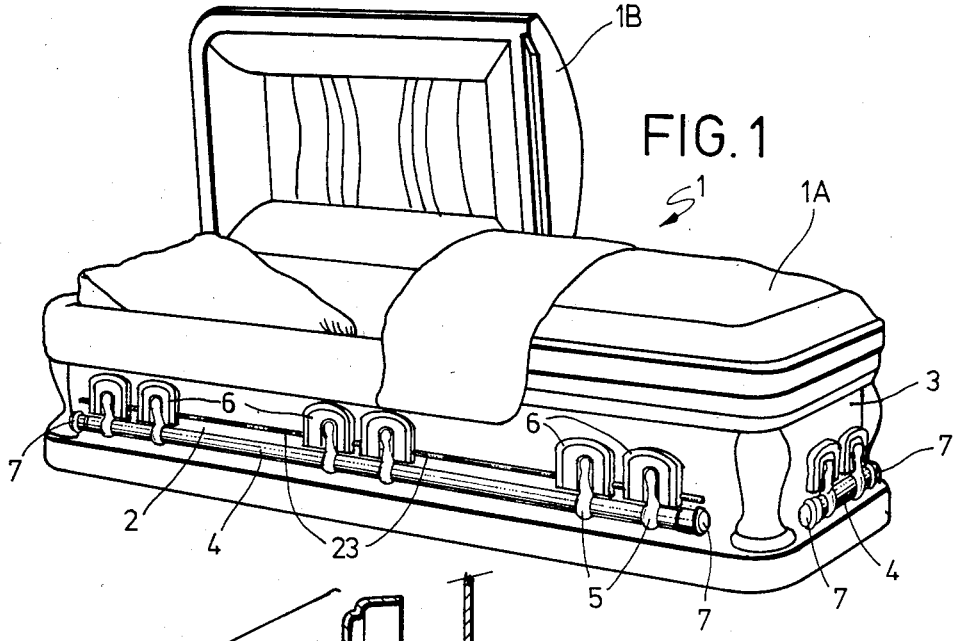
FIG. 1 is a perspective view of a burial casket employing the dual-functioning trim and alignment strip of the present invention.

As illustrated in FIG. 1, the burial casket comprises a lid section 1, which is, e.g., divided into head and foot sections 1B and 1A. The casket lid or cap is hingedly attached to a base section comprising two side walls and two end walls. One such side wall 2 and one end wall 3 are shown in FIG. 1.

Attached to one or more of the side or end walls of the base section of the burial casket are handles 4. These handles are attached to handle arms 5, which are inserted through decorative plates 6 and into casket wall 2 or 3, where they are held in place by appropriate fastening means (not shown in FIG. 1). Burial casket handles 4 may be held in place from excessive sideways motion e.g., by end caps 7 or by fastening means cooperating with one or more handles 5.

Figure 2:
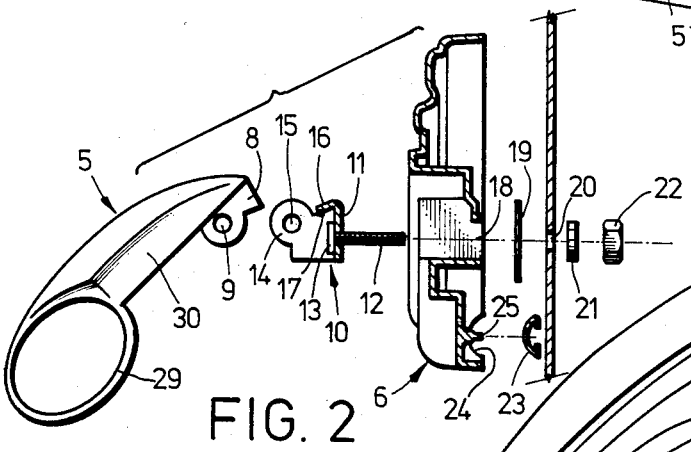
FIG. 2 is a side elevational view of a portion of the hardware assembly which is attached to the side of a burial casket, particularly showing a side elevational view of the handle arm and side elevation cross sections of the handle clip, decorative plate, trim strip and casket wall.

As illustrated in FIG. 2, handle 5 comprises a hollow portion 29, a center portion 30 and an end portion 8. End portion 8 has a transverse bore 9 through which a fastening means, e.g., a rivet (not shown) is passed to secure the handle arm to a mounting means. A preferred mounting means is mounting clip 10, which is generally U-shaped, having a bight portion 11 in which a bolt hole is formed and through which a bolt 12 having a head 13 or other suitable fastening means passes. The head 13 of the bolt is preferably connected to the bight portion 11 of the clip by a swaging operation, or is welded. The clip 10 is also provided with mounting ears 14 having a hole 15 by which the mounting ear may be riveted or otherwise fastened to the end of an arm 5. A bearing flange 16 is bent from the bight portion 11 through an angle slightly greater than 90° to lie against the edges 17 of ear 14.

Each arm 5 has at its end 8 a transverse bore 9 through which a rivet passes to secure the mounting clip 10 to the end of the arm. When the mounting clip is riveted in position, a bearing surface on the end 8 of the arm 5 engages the bearing flange 16 on the clip 10 to form a load bearing stop when the handle is swung away from the casket wall to a lifting position. The other end 29 of arm 5 is a hollow portion comprising a large, transverse hole or bore which generally matches the contour of the handle 4. Handle 4 may be of any desirable countour or cross section, an eliptical contour or cross section being shown in handle 4 in FIG. 1 and in end portion 29 of arm 5 in FIG. 2. End caps 7 also have the same general contour of handle 4 and fit in a cooperating manner with the ends of handle 4. Handle 4 may be secured to arm 5 in any suitable manner, e.g., by a screw placed through the wall of end portion 29 or arm 5 which is adjacent the exterior casket wall 2.

Bolt 12 is passed through opening 18 in decorative plate 6, through washer 19, which may be constructed of any convenient material, e.g., plastic, and further through aperture 20 in casket wall 2. Bolt 12 is secured on the interior portion of casket wall 2 by any suitable fastening means. In the preferred embodiment of this invention, bolt 12 is passed through a resilient washer 21 and threaded onto nut 22. When nut 22 is tightened down onto bolt 12, securing the handle, arm and decorative plate in place, resilient washer 21 is compressed to seal the aperture 20 in casket wall 2. The plastic washer 19 on the outside surface of the casket wall provides an additional seal for the bolt aperture 20.

FIG. 2 also shows alignment/trim strip 23. This strip may be constructed of any convenient configuration, e.g., the C-shaped configuration shown in FIG. 2. Preferably, alignment/trim strip 23 is constructed of any suitable metal or other material e.g., a vacuum-metallized stainless steel. A portion 24 of the side wall of the decorative plate is shaped to conform to the exterior face of alignment/trim strip 23. In this fashion, the alignment/trim strip causes the decorative plate to be properly aligned when assembled. Protrusion or boss 25 is also shown in FIG. 2. Boss 25 cooperates with a hole or aperture in alignment/trim strip 23 to hold the alignment/trim strip to the decorative plate in position for mounting on the casket wall. The boss may be sized to permit a physical force-fit attachment, or may be secured to the alignment strip in any other convenient fashion. Trim strip 23 is mounted in a generally horizontal position with respect to the casket, in the general direction of the handle. Any suitable fastening means may be employed in place of boss 25 to secure the trim strip to the decorative plate.

Figure 3:
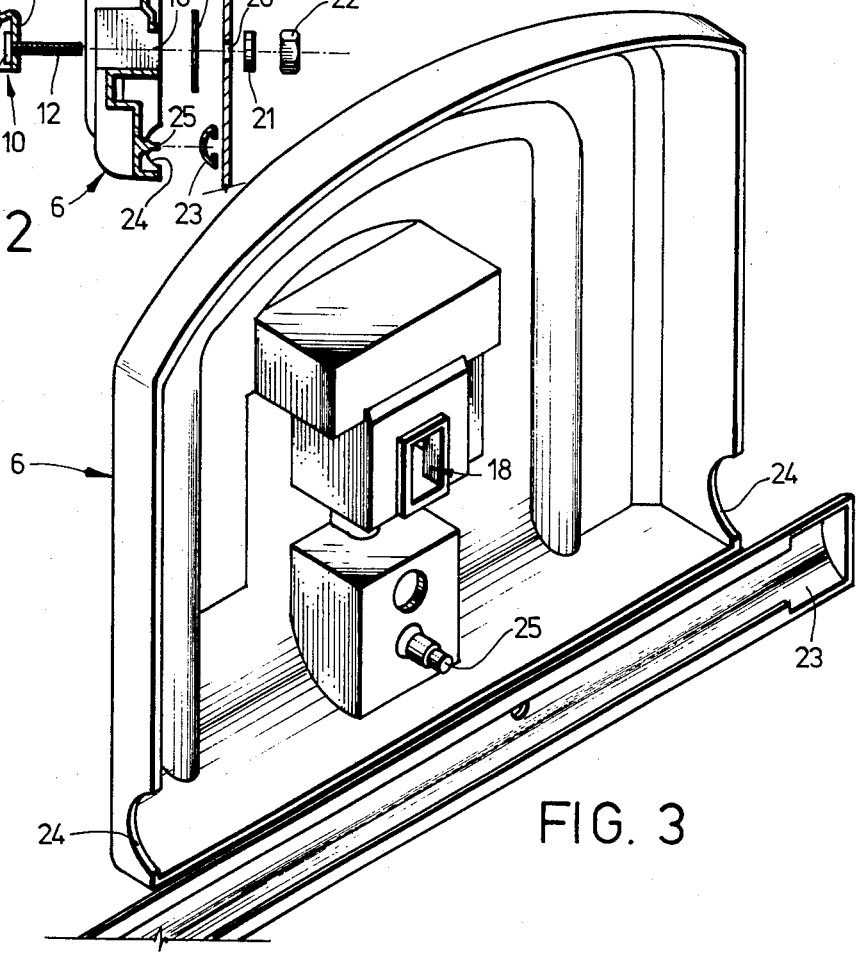
FIG. 3 is an enlarged perspective view of the back side of a decorative plate and alignment/trim strip employed in the present invention.

FIG. 3 shows a typical interior configuration for decorative plate 6. The plate 6 is formed by any convenient process. Preferably, a pressure casting process is employed in which molten zinc is injected into a mold cavity. After a brief chilling period, the mold is opened providing a casting having a wall thickness of, e.g., approximately 3/64 of an inch. The casting has a finished front surface and an unfinished rear surface.

FIG. 3 also shows the configuration of alignment/trim strip 23 in the preferred embodiment of this invention, and the details of boss 25. Boss 25 cooperates with aperture 26 in alignment/trim strip 23 to secure the alignment/trim strip 23 to the boss 25 on decorative plate 6. Also shown in FIG. 3 are the sections 24 of decorative plates 6 which are configured to receive alignment/trim strip 23.

Figure 4:
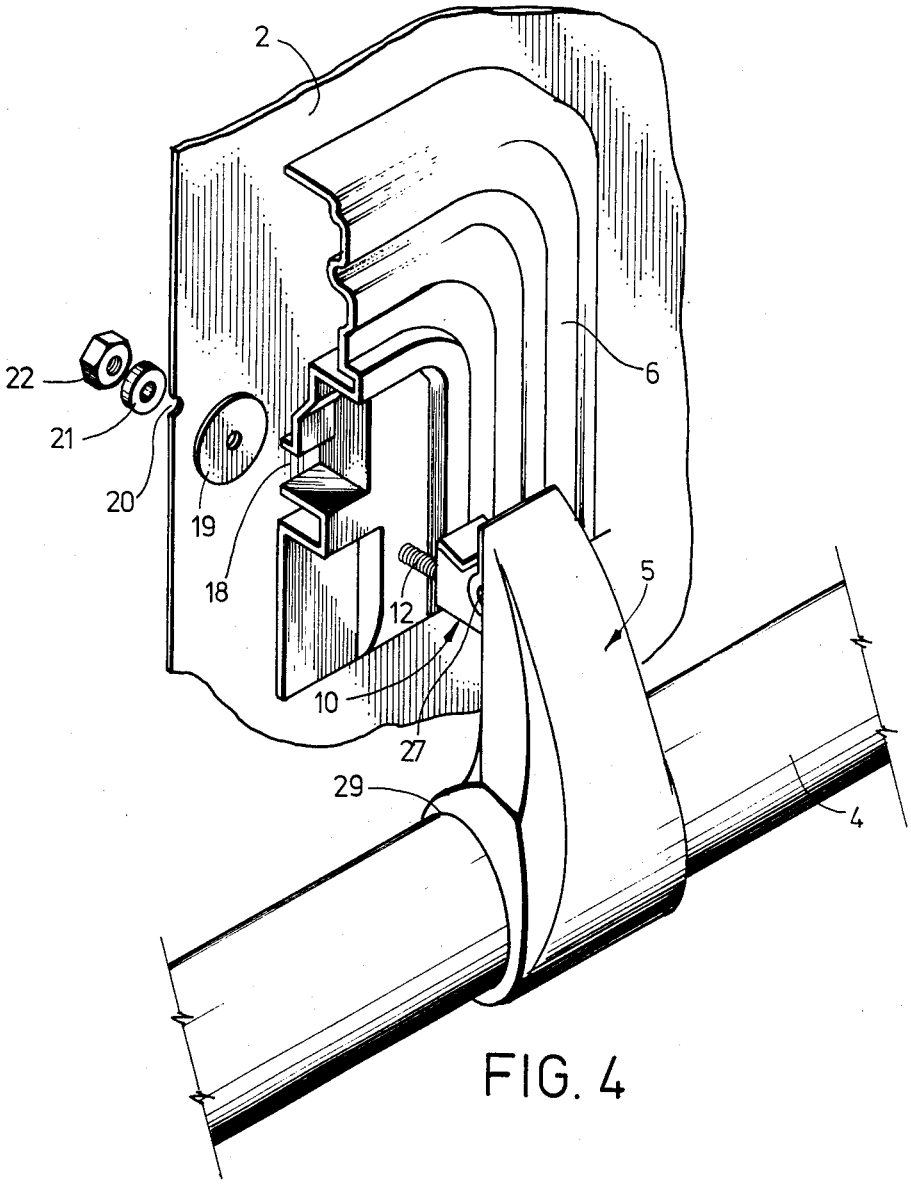
FIG. 4 is a perspective view of the casket handle assembly employed in the present invention and a perspective sectional view of a burial casket wall and the decorative plate employed in the present invention.

FIG. 4 shows a portion of handle 4 in place in the hollow end section 6 of arm 5. FIG. 4 also shows mounting clip 10 in place on arm 5, and held in place by rivet 27. Plastic washer 19, resilient washer 21 and nut 22 are shown in the unassembled position adjacent the portion of casket wall 2 and decorative plate 6. In assembly, bolt 12 is inserted through aperture 18 in plate 6, a portion of which aperture is shown in FIG. 4. The bolt is subsequently passed through washer 19, through casket wall aperture 20 and through resilient washer 21. Nut 22 is threaded onto bolt 12 to attach the assembly.

The present invention is generally applicable to caskets constructed of any materials. The materials employed in construction of the casket, hardware and alignment/trim strip, e.g., may be constructed of metal, wood, plastic or any other desired material. Although the present invention has been described in connection with the preferred embodiments thereof, it will be appreciated by those skilled in the art that additions, modifications, substitutions and deletions not specifically described may be made without departing from the spirit and scope of the invention as defined in the appended claims.

What is claimed is:

1. A device for aligning prior to assembly to a burial casket decorative plates used to conceal the attachment of carrying handles and handle arms to the burial casket comprising:

(a) at least two spaced apart plates each having a front decorative surface and a rear casket-wall abutting surface for positioning adjacent a wall of said burial casket, the rear surface of each of said plates being configured to receive a portion of an aligning means;

(b) at least one fastening means comprising at least one protrusion extending from the rear surface of each of said decorative plates;

(c) and an aligning means comprising a generally linear strip cooperating with said at least one fastening means to secure said aligning means in abutting relation to the configured portion of said decorative plates and to position said decorative plates horizontally and vertically with respect to each other and to said generally linear strip for subsequent assembly to said burial casket wall without additional alignment.

2. The device according to claim 1 wherein said linear strip is a vacuum metalized strip of stainless steel.

3. The device according to claim 1 wherein said strip is generally C-shaped.

4. The device according to claim 1 wherein said strip comprises an aperture positioned to receive said protrusion, whereby said aperture and said protrusion are joined in a force-fit relationship prior to assembly to said burial casket.

* * * * *